US005704243A

United States Patent [19]

Hada et al.

[11] Patent Number: 5,704,243

[45] Date of Patent: Jan. 6, 1998

[54] FORMING METHOD AND FORMING STAND FOR WELDED PIPES

[75] Inventors: Kenji Hada; Yasuo Kimiya; Daigo Sumimoto, all of Kimitsu, Japan

[73] Assignee: Nippon Steel Corporation, Tokyo, Japan

[21] Appl. No.: 718,289

[22] Filed: Sep. 20, 1996

Related U.S. Application Data

[63] Continuation of Ser. No. 244,285, filed as PCT/JP93/01265, Sep. 7, 1993, published as WO94/07621, Apr. 14, 1994.

[30] Foreign Application Priority Data

| | | | |
|---|---|---|---|
| Sep. 25, 1992 | [JP] | Japan | 4-256708 |
| Jan. 29, 1993 | [JP] | Japan | 5-014282 |
| Jan. 29, 1993 | [JP] | Japan | 5-014283 |
| Jan. 29, 1993 | [JP] | Japan | 5-014284 |

[51] Int. Cl.[6] ..... B21D 5/12

[52] U.S. Cl. ..... 72/178; 72/224

[58] Field of Search ..... 72/178, 182, 181, 72/52, 51, 224, 225; 228/17, 17.5, 147

[56] References Cited

U.S. PATENT DOCUMENTS

| | | | |
|---|---|---|---|
| 231,146 | 8/1880 | Briggs | 72/224 |
| 5,142,894 | 9/1992 | Gutowski | 72/181 |

FOREIGN PATENT DOCUMENTS

| | | | |
|---|---|---|---|
| 49-35500 | 9/1974 | Japan . | |
| 62-166027 | 7/1987 | Japan . | |
| 1-44217 | 2/1989 | Japan . | |
| 2-104419 | 4/1990 | Japan . | |
| 118923 | 5/1991 | Japan | 72/178 |
| 41021 | 2/1992 | Japan | 72/52 |
| 4-182034 | 6/1992 | Japan . | |

*Primary Examiner*—Daniel C. Crane
*Attorney, Agent, or Firm*—Kenyon & Kenyon

[57] ABSTRACT

The present invention is to provide a forming method and forming stand for forming a welded pipe of high dimensional accuracy on a welded pipe manufacturing line in which a metallic strip of a predetermined width is continuously formed by rolls and then welded, and more particularly the present invention is to provide a forming method and forming stand for forming both edge portions of the metallic strip with high accuracy. Positions of two pairs of upper and lower horizontal forming rolls or two upper horizontal forming rolls, the rolls being provided when the upper and lower horizontal rolls are divided into two with respect to the width direction of the metallic strip, can be adjusted in the width direction, and each divided upper roll can be turned and fixed on a vertical axis. Further, in order to exhibit the effect of the present invention at the maximum, the turning direction and turning angle of each upper roll is limited. When the forming stand is constructed in the above manner, the edges of the metallic strip can be appropriately formed without deteriorating the accuracy of wall thickness of the metallic strip to be formed, and further the roll can be shared when metallic strips of different pipe diameters are formed.

4 Claims, 11 Drawing Sheets

FORMING METHOD AND FORMING STAND FOR WELDED PIPES

This application is a continuation of application Ser. No. 08/244,285, filed May 23, 1994, now abandoned, which is a 371 of PCT/JP93/01265, filed Sep. 7, 1993.

BACKGROUND OF THE INVENTION

1. Field of the Invention

The present invention relates to a forming method and forming stand for forming welded pipes to accurate dimensions in a welded pipe manufacturing line on which a metallic strip of a predetermined width is continuously formed by rolls and welded by the electric resistance welding method or other welding methods.

2. Related Art

In general, in a manufacturing process in which welded pipes such as electric resistance welded pipes are manufactured, a metallic strip of a predetermined width is continuously supplied to a group of forming rolls including a plurality of breakdown rolls, side rolls and fin-pass rolls, and then the formed metallic strip is subjected to welding such as high frequency welding in which squeeze rolls are used.

According to this method, welded pipes are continuously manufactured. Therefore, this method is greatly advantageous in that the manufacturing efficiency is improved and the cost is reduced. Accordingly, this method is widely used when mechanical structure pipes, boiler pipes, oil well pipes and other various pipes are manufactured. Recently, there is a demand for applying this method to the manufacture of thin wall pipes, thick wall pipes and high tensile strength pipes. Further, there is a strong demand for manufacturing pipes of high quality and high accuracy.

However, when these thin wall pipes, thick wall pipes and high tensile strength pipes are formed by the conventional pipe manufacturing method, the profiles of these pipes are defective. To describe this in detail, in the initial process of edge forming in which a pair of breakdown rolls composed of upper and lower rolls are used, the edge portions of a work piece are lack of bending.

In order to solve the above problem, a "W-bend method", in which the middle portion of a work piece is bent at a radius of curvature opposite to that of a product in the edge forming process and both edge portions of the work piece are bent to the same side as that of the product has come into practical use. The effect of this method is introduced, for example, on page 519 of the proceedings of a plastic working lecture meeting (held in spring of 1985) published by the Plastic Working Society.

According to the method disclosed in Japanese Unexamined Patent Publication (Kokai) No. 1-44217, two rolls are constituted for the horizontal lower caliber roll applied to the edge forming roll stand, and the inclination angles of the two rolls are capable of being adjusted with respect to the metallic strip advancing direction, so that the edge portions of both thick and thin wall metallic strips are sufficiently bent.

In the process for manufacturing metallic pipes by means of roll forming and welding, it is desired to provide forming rolls capable of being applied for manufacturing various sizes of pipes for the purpose of reducing the roll cost by reducing the number of rolls, and also for the purpose of improving the operation rate of the manufacturing line by reducing the frequency of roll change. In order to accomplish the above object, a set of rolls are disclosed in Japanese Unexamined Patent Publication (Kokai) No. 62-166027, and these rolls have been put into practical use.

As described above, in the breakdown roll used for edge forming in the conventional pipe forming method, the problem of defective profile is caused especially when thin wall pipes, thick wall pipes and high tensile strength pipes are formed. In the case where the work piece is additionally subjected to edge forming by the fin-pass rolls disposed in the after-stage so as to solve the problem of defective profile, the thickness of the edge portion is increased as shown by numeral 1 in FIG. 1. This increase of thickness 1 is a factor to deteriorate the size accuracy.

In the case of a breakdown roll of the W-bend system, a sufficiently high bending force can be applied to the edge portions compared with the conventional method. However, in the forming process from the start of contact of a work piece with an upper roll, to a position right below the roll, the upper roll locally comes into contact with the work piece. Therefore, an indentation 2 tends to occur as illustrated in FIG. 2, which is a factor to deteriorate the accuracy of thickness. Even when this method is applied, the problem of defective profile cannot be essentially solved in the case where thick wall and thin wall pipes exceeding the designed thickness of the upper roll 3 are formed. Therefore, this method is not sufficient for extending the range of wall thicknesses to which the same forming roll can be applied.

On the other hand, in the edge forming method disclosed in Japanese Unexamined Patent Publication (Kokai) No. 1-44217 described before, since a work piece continuously comes into contact with the edge forming roll, the occurrence of indentations can be avoided as compared with the conventional edge forming method. However, according to this method, only the lower rolls are crossed and tilted. Accordingly, from the viewpoint of construction, the range of wall thickness to which the same edge forming roll can be applied is limited.

On the other hand, the edge forming rolls disclosed in Japanese Unexamined Patent Publication (Kokai) No. 62-166027 can be applied to a wide range of pipe diameters, however, since the radius of curvature of the roll is continuously changed, the roll locally comes into contact with a metallic strip, so that the problem of defective profile tends to occur, and this method is not appropriate for forming thick wall pipes.

SUMMARY OF THE INVENTION

The present invention has been achieved to solve the above problems in the prior art. It is an object of the present invention to provide a forming method and forming stand applied to a welded pipe manufacturing line by which welded pipes of high size accuracy can be formed and especially edge portions of a metallic strip can be accurately bent.

The summary of the invention will be described as follows.

(1) A welded steel pipe forming method comprising the step of bending the edges of a metallic strip of a predetermined width in a manufacturing line for roll-forming and welding the metallic strip, wherein each edge of the metallic strip is bent with a pair of upper and lower horizontal rolls provided when a pair of horizontal rolls is divided into two with respect to the width direction of the metallic strip, and the upper and lower horizontal rolls are crossed to each other being turned on a vertical turning axis.

(2) The welded steel pipe forming method according to item (1), wherein the upper roll turning angle $\alpha_u$ and lower roll turning angle $\alpha_d$ of the pair of upper and lower horizontal forming rolls are determined to satisfy the following inequalities, wherein the turning directions of the upper and lower rolls are set to be opposite to each other.

$$\alpha_u \leqq 45°$$

$$\alpha_d \leqq 30°$$

where $\alpha_u$: an angle formed between a line in the width direction of the metallic strip and a roll axis of the upper horizontal roll $\alpha_d$: an angle formed between a line in the width direction of the metallic strip and a roll axis of the lower horizontal roll (3) The welded steel pipe forming method according to item (1) or (2), wherein the turning angles of the upper and lower horizontal rolls are determined so that the upper roll is directed to the edge side of the metallic strip at an entry side of the roll stand and directed to the center side of the metallic strip at a delivery side of the roll stand.

(4) A welded steel pipe forming method comprising the step of bending the edges of a metallic strip of a predetermined width in a manufacturing line for roll-forming and welding the metallic strip, wherein each edge of the metallic strip is bent with an upper horizontal roll provided when a horizontal roll is divided into two with respect to the width direction of the metallic strip, and the upper horizontal roll is turned and fixed on a vertical turning axis.

(5) The welded steel pipe forming method according to item (4), wherein the upper horizontal roll turning angle $\alpha_u$ is determined to satisfy the following inequality.

$$\alpha_u \leqq 45°$$

where $\alpha_u$: an angle formed between a line in the width direction of the metallic strip and a roll axis of the upper horizontal roll (6) The welded steel pipe forming method according to item (4) or (5), wherein the turning angle of the upper horizontal roll is determined so that the upper horizontal roll is directed to the edge side of the metallic strip at an entry side of the roll stand and to the center side of the metallic strip at a delivery side of the roll stand.

(7) A welded steel pipe forming method comprising the step of bending the edges of a metallic strip of a predetermined width in manufacturing line for roll-forming and welding the metallic strip, wherein each edge of the metallic strip is bent with a pair of upper and lower horizontal rolls provided when a pair of horizontal rolls is divided into two with respect to the width direction of the metallic strip, and the upper and lower horizontal rolls are disposed at different positions with respect to the metallic strip forming direction and crossed to each other being turned on a vertical turning axis.

(8) A forming stand for forming welded pipes used for a group of initial forming rolls in a manufacturing line for forming and welding a metallic strip of a predetermined width, comprising: two pairs of upper and lower horizontal rolls for bending the edges of the metallic strip, the upper and lower horizontal rolls being provided when the upper and lower horizontal rolls are divided into two with respect to the width direction of the metallic strip, wherein the positions of upper and lower rolls on both sides can be adjusted being turned on a vertical turning axis, and the positions of upper and lower rolls with respect to the width direction of the metallic strip can be also adjusted.

(9) A forming stand for forming welded pipes used for a group of initial forming rolls in a manufacturing line for forming and welding a metallic strip of a predetermined width, comprising: two upper horizontal rolls for bending the edges of the metallic strip, the two upper horizontal rolls being provided on both sides when an upper horizontal roll is divided into two with respect to the width direction of the metallic strip, wherein the positions of upper rolls on both sides can be adjusted being turned on a vertical turning axis, and the positions of upper rolls with respect to the width direction of the metallic strip can be also adjusted.

(10) The forming stand for forming welded pipes according to item (8) or (9), wherein the divided horizontal rolls are disposed at different positions with respect to the metallic strip forming direction.

DESCRIPTION OF TEE MOST PREFERRED EMBODIMENT

Figure 1:
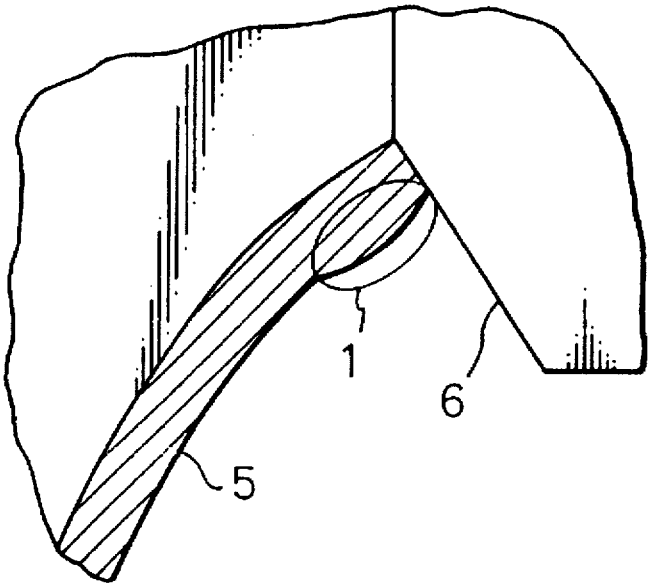
FIG. 1 is a sectional view of a metallic strip, the edge thickness of which is increased, which deteriorates the size accuracy.
Figure 2:
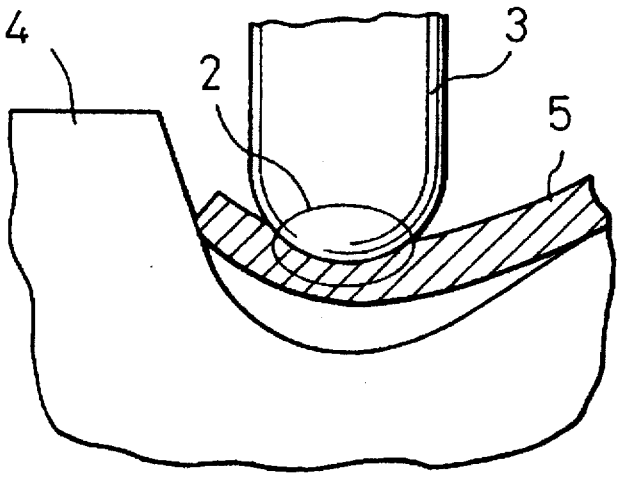
FIG. 2 is a sectional view of a metallic strip on which a bend indentation is caused, which deteriorates the size accuracy.
Figure 3:
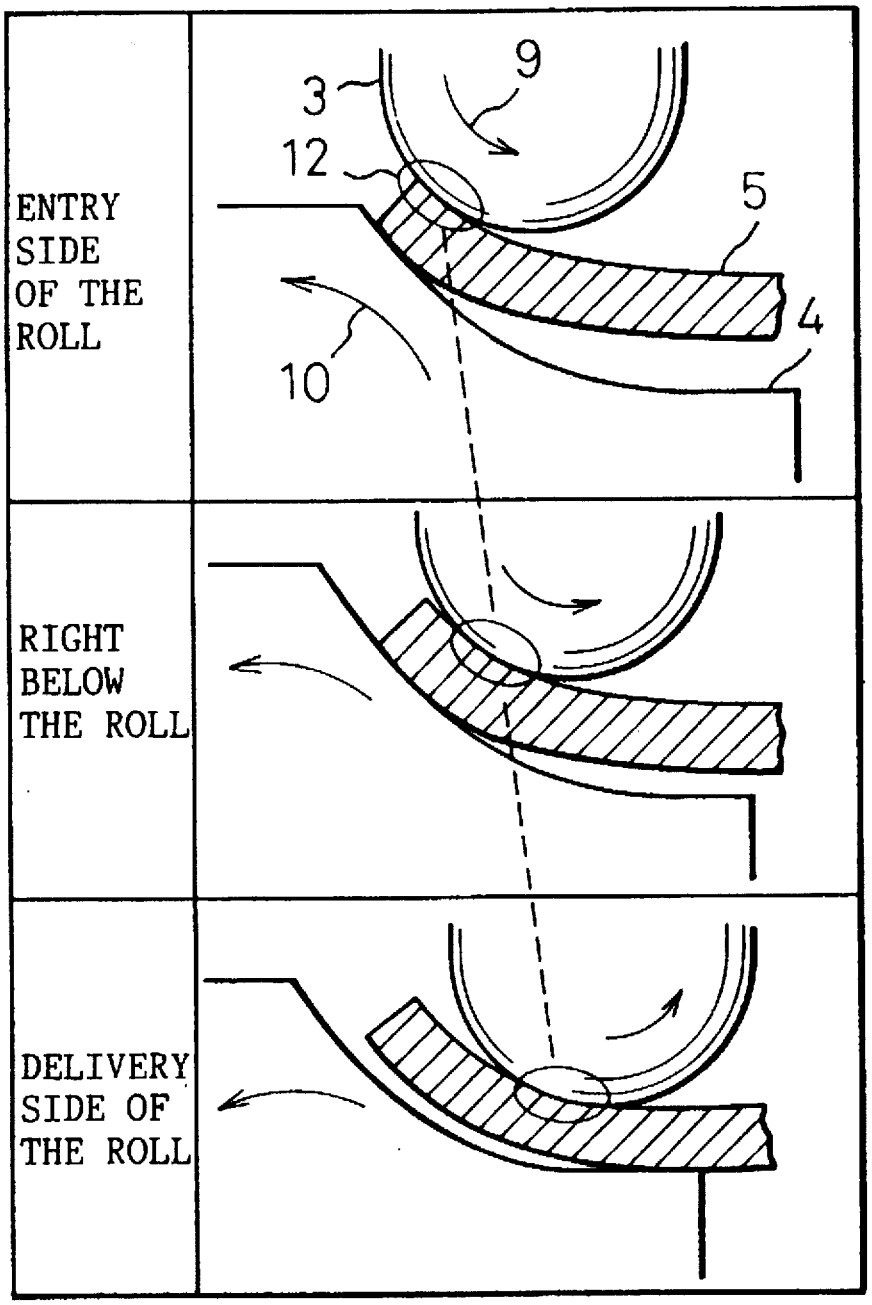
FIG. 3 is a view showing the progress of forming of a metallic strip right below the forming roll.
Figure 4A:
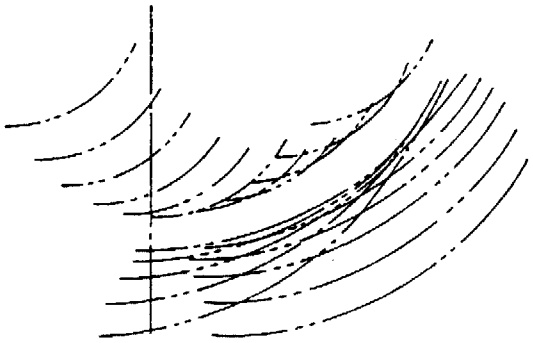
FIGS. 4(*a*), 4(*b*), 4(*c*) and 4(*d*) are views showing the example of the present invention of a gap formed between the upper and lower rolls in accordance with the forming radius of curvature and the thickness, wherein FIG. 4(*a*) shows a case of a thin wall, FIG. 4(*b*) shows a case of a small radius of curvature (large diameter), FIG. 4(*c*) shows a case of a thick wall, and FIG. 4(*d*) shows a case of large radius of curvature (small diameter).
Figure 4B:
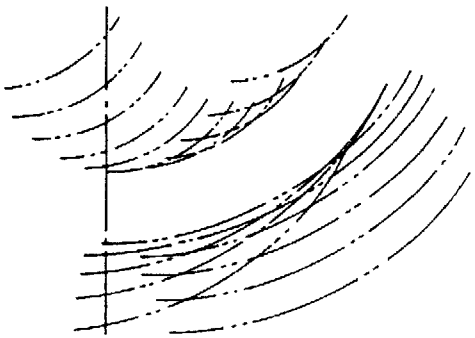
Figure 4C:
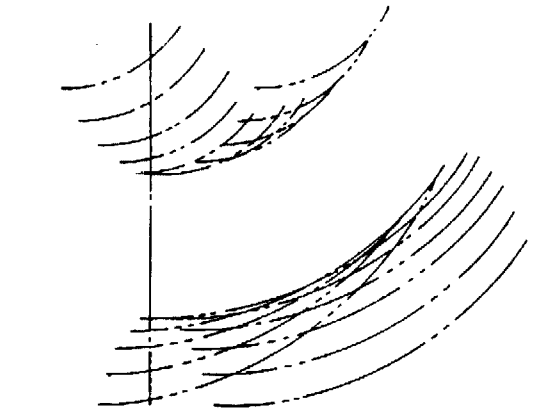
Figure 4D:
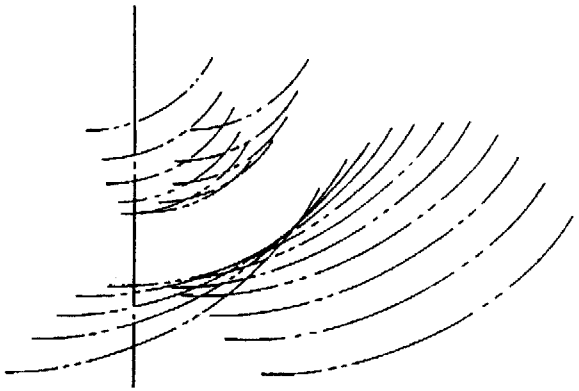
Figure 8B:
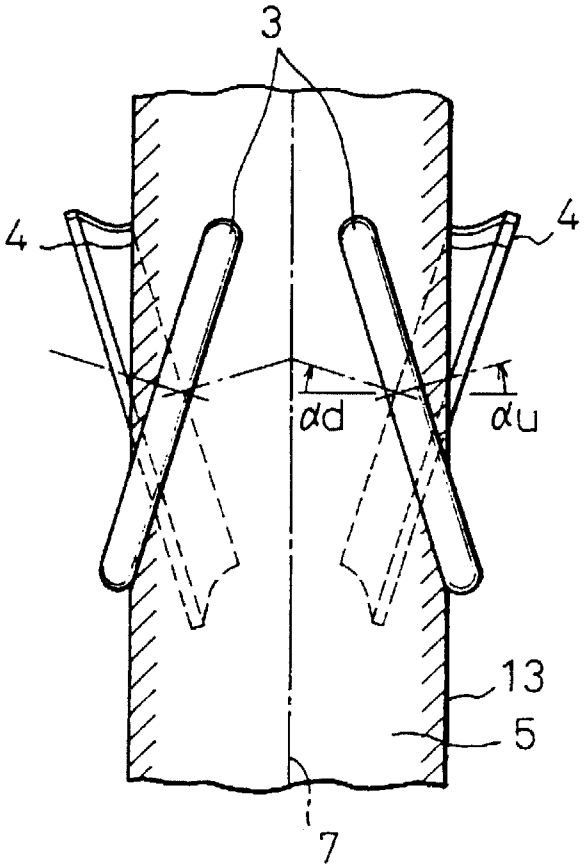
FIGS. 8(*a*) and 8(*b*) are plan views showing an example of the roll to which the present invention is applied, wherein FIG. 8(*a*) is a front view and FIG. 8(*b*) is a plan view.
Figure 8A:
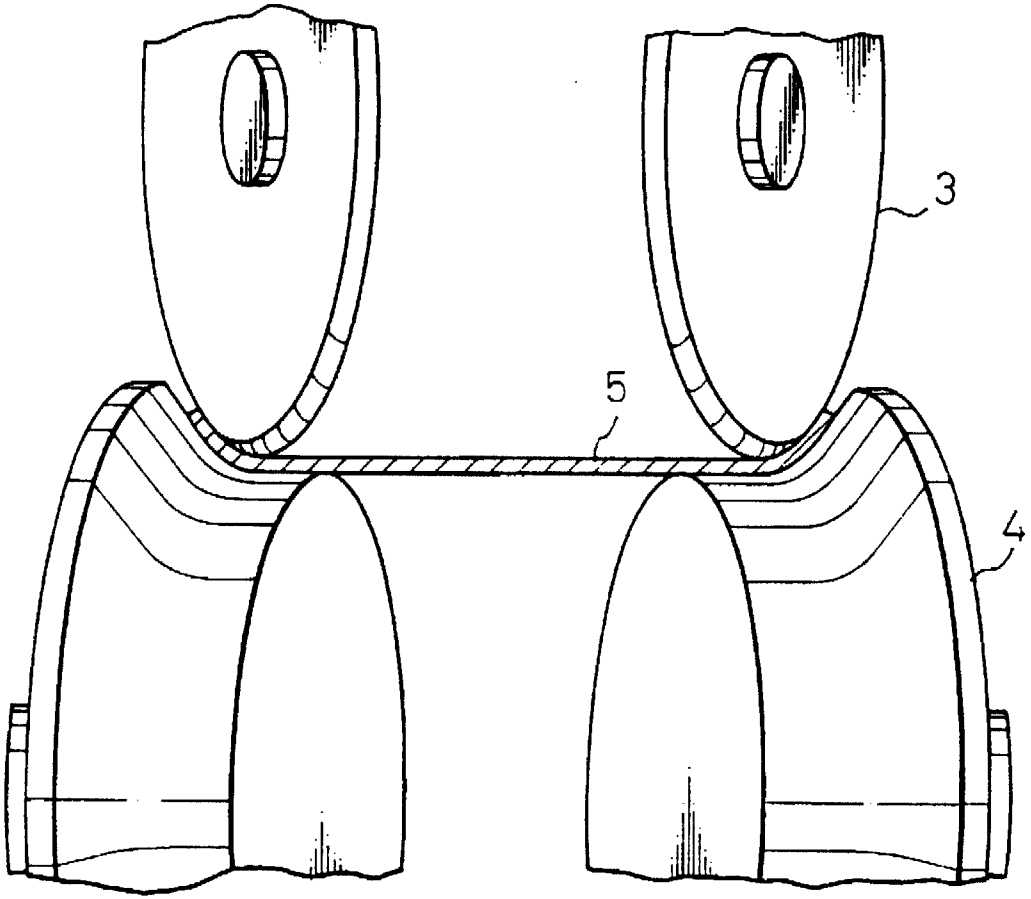

According to the present invention, as illustrated in FIG. 8, metallic strips can be accurately formed into pipes with thin or thick walls with two pairs of upper and lower horizontal edge forming rolls disposed on both sides of the metallic strip in a breakdown stand for the purpose of edge forming, the two pairs of rolls being provided when a pair of upper and lower rolls are divided into two with respect to the width direction of the metallic strip, wherein the edge forming is performed under the condition that the pair of upper and lower horizontal rolls are crossed by being turned on a vertical axis. As illustrated in FIG. 3, a pair of upper and lower horizontal edge forming rolls 3, 4 are crossed, and the upper and lower rolls are continuously contacted with both sides of a metallic strip 5 to be formed right below the upper forming roll. Therefore, in this forming process, a local contact of the forming roll and the metallic strip can be avoided, which is different from the forming process of the prior art. With reference to FIGS. 4(*a*) to 4(*c*), FIG. 4(*a*) shows a case of a small wall thickness, FIG. 4(*b*) shows a case of a small radius of curvature (large pipe diameter), and FIG. 4(*c*) shows a case of large wall thickness. As shown in the drawings, when the turning angle of the upper roll 3 is changed, the radius of curvature right below the upper forming roll, which is made by the hysteresis of the upper roll, is changed, so that the hysteresis of the gap between the upper and lower rolls can be provided in accordance with the thickness of the metallic strip to be formed. Therefore, edge forming can be accurately performed with respect to a wall thickness range which includes thin and thick walls.

Further, with reference to FIG. 4(*d*) in which a case of a large radius of curvature (small pipe diameter) is shown, when the turning angle of the lower roll is changed, the radius of curvature formed by the lower roll coming into contact with the outside of the metallic strip is changed, and when two pairs of upper and lower rolls disposed on both sides are moved so as to be adjusted in the width direction of the metallic strip in accordance with the strip width. In this way, the edge forming rolls can be shared by metallic strips of different sizes from which pipes of different sizes are formed.

In general, the turning angle of the upper roll is determined by the profile of the upper roll caliber, the outside diameter of the pipe to be formed from the metallic strip, the wall thickness of the metallic strip, and the upper roll diameter. Also, the turning angle of the lower roll is determined by the profile of the lower roll caliber, the outside diameter of the pipe to be formed from the metallic strip, and the lower roll diameter. In the second embodiment of the present invention, in order to exhibit the effect of the invention at the maximum, the turning angle directions of the upper and lower rolls are limited as follows.

It is necessary to increase the turning angle of the upper roll when the wall thickness of the metallic strip is small. However, when the turning angle is increased too much, an amount of slippage caused between the upper roll and the metallic strip is increased. As a result, the strip surface is damaged, the forming rolls are seized, and the roll life is reduced. For this reason, while consideration is given to the sharable range of metallic strips to be formed, the upper limit of the turning angle is determined to be 45°.

When the turning angle of the lower roll is increased, the sharable range of metallic strips to be formed is extended. However, when the turning angle is extremely increased, the same problems as those described above are caused, and further the sharable range of metallic strips is limited due to the interference of the upper and lower rolls disposed on both sides. Accordingly, consideration is given to the sharable range of the metallic strips to be formed, and the upper limit of the turning angle is determined to be 30°. Due to the foregoing, the sharable range of the diameter of the pipe to be formed from the metallic strip can be extended by 1.5 to 2.0 times.

Further, according to the present invention, each pair of upper and lower rolls are disposed at different positions with respect to the metallic strip forming direction. Therefore, after the forming of one edge of the metallic strip has been started, the forming of the other edge is started. Due to the foregoing, in the case where small size pipes are formed, interference of the forming rolls on both sides caused when the upper and lower rolls are turned can be avoided, so that the turning angles of the forming rolls are not restricted. In this case, an interval with respect to the metallic strip forming direction between the pairs of upper and lower rolls disposed on both sides, is determined by the diameters of the upper and lower rolls and the range of the designed turning angle.

Next, a case will be explained as follows in which the upper horizontal roll is divided into two rolls.

The horizontal upper rolls divided with respect to the metallic strip width direction are disposed on both sides for the purpose of edge forming. Then horizontal upper rolls are turned on and fixed at a vertical axis. When the metallic strip is formed under the above condition, pipes of various wall thickness, that is, pipes of thin and thick walls can be formed with high accuracy. The reason why the pipes of various wall thickness can be accurately formed in the above manner will be described as follows: As illustrated in FIG. 3, when the upper horizontal forming roll is turned on a vertical axis, the upper roll 3 continuously comes into contact with the edge of the metallic strip to be formed right below the roll on both sides, so that both edge portions of the metallic strip are subjected to forming. Therefore, the occurrence of local contact, which tends to occur when the conventional method is applied, can be avoided in the forming process. Also, as illustrated in FIGS. 4(*a*) to 4(*c*), when the turning angle of the upper roll 3 is changed, the radius of curvature, which is formed by the hysteresis of a portion right below the upper roll, is changed. Accordingly, the hysteresis of a gap can be constructed in accordance with the wall thickness of the metallic strip to be formed. Therefore, pipes with thin or thick walls can be formed with high accuracy.

The turning angle of the upper roll is determined by the profile of the upper roll caliber, the outside diameter of the pipe to be formed from the metallic strip, the wall thickness of the metallic strip, and the upper roll diameter. In the fifth embodiment of the present invention, in order to exhibit the effect of the invention at the maximum, the turning angle direction of the upper roll is limited as follows.

It is necessary to increase the turning angle of the upper roll when the wall thickness of the metallic strip is small. However, when the turning angle is increased too much, an amount of slippage caused between the upper roll and the metallic strip is increased. As a result, the strip surface is damaged, the forming rolls are seized, and the roll life is reduced. For this reason, while consideration is given to the sharable range of metallic strips, the upper limit of the turning angle is determined to be 45°.

Figure 5A:
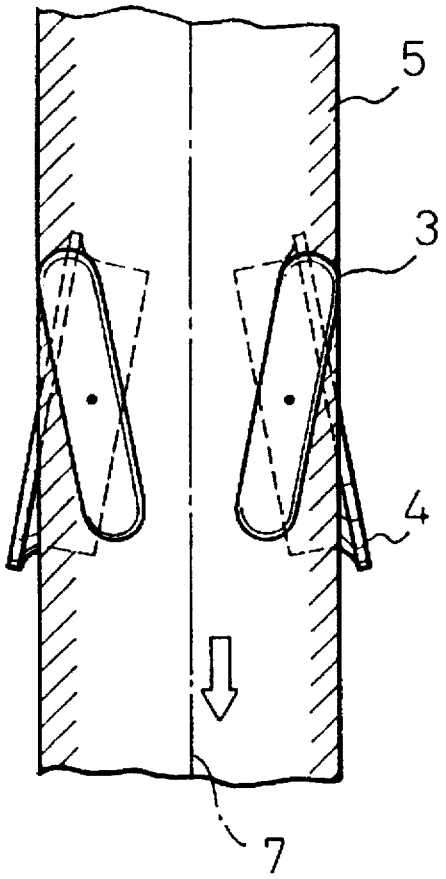
FIGS. 5(*a*) and 5(*b*) are schematic illustrations showing the direction of a roll, wherein FIG. 5(*a*) shows a case of the forming roll of the invention directed inside, and FIG. 5(*b*) shows a case of the forming roll of the invention directed outside.
Figure 5B:
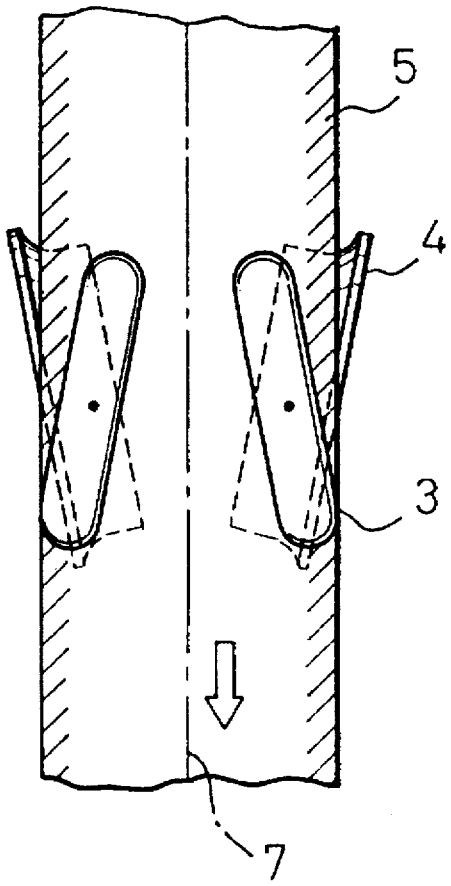
Figure 6:
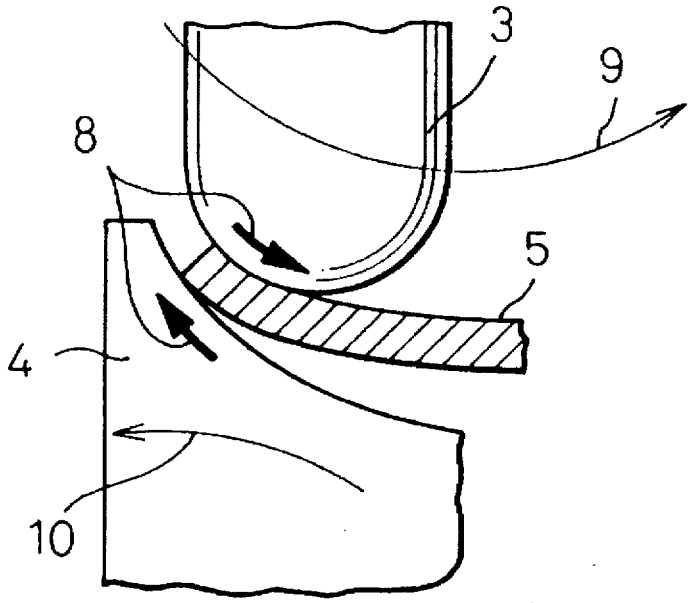
FIG. 6 is a schematic illustration showing the direction of a thrust in the case of the forming roll of the invention directed inside.
Figure 7:
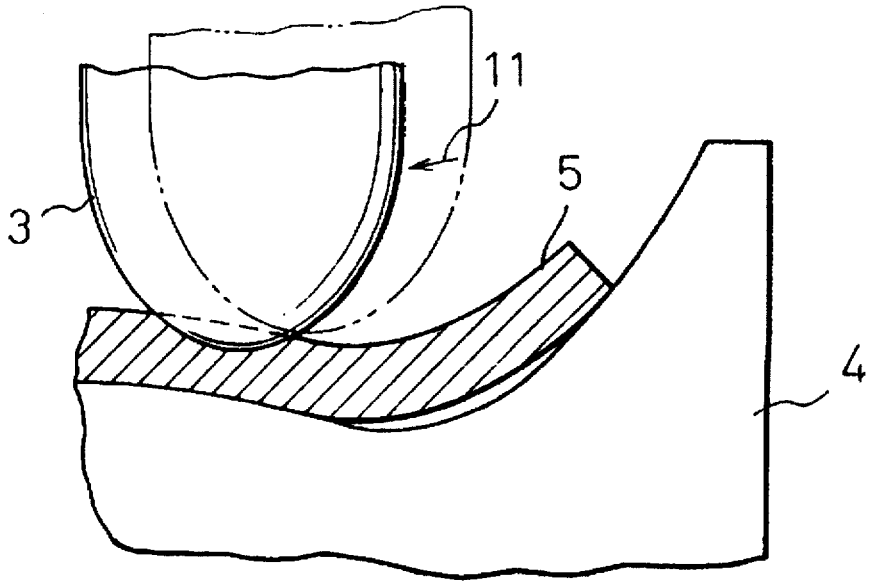
FIG. 7 is a schematic illustration showing a case in which the upper roll deviates in the case of a forming roll of the invention directed outside.

Next, the roll direction will be explained as follows. In the case where the upper and lower rolls are divided into two, a slippage is caused between the rolls and the metallic strip when the upper and lower rolls are turned. Therefore, a force is applied to the rolls in the width direction of the metallic strip, and torsion is generated in the rolls. For example, as illustrated in FIG. 5(*a*), the upper rolls are positioned in such a manner that the rolls are directed to the edges of the metallic strip on the entry side of the roll stand and also the rolls are directed to the center of the metallic strip on the delivery side of the roll stand. The lower rolls are positioned in the opposite direction to that of the upper roll. In the manner described above, the upper and lower rolls are crossed with each other. In this case, since the contact point between the upper roll and the metallic strip is shifted from the edge portion to the center of the metallic strip, the above roll arrangement will be referred to as "a forming roll arrangement directed inside", hereinafter. In this case, as illustrated in FIG. 6, the upper roll is given a thrust directed inside, and the lower roll is given a thrust directed outside. Also, a deviation directed outside with respect to the width direction is caused in the upper roll, and a deviation directed inside with respect to the width direction is caused in the lower roll. On the other hand, as illustrated in FIG. 5(*b*), the upper rolls are positioned in such a manner that the rolls are directed to the center of the metallic strip on the entry side of the roll stand and also the rolls are directed to the edge of the metallic strip on the delivery side of the roll stand. The lower rolls are positioned in the opposite direction to that of the upper roll. In the manner described above, the upper and lower rolls are crossed with each other. In this case, since the contact point between the upper roll and the metallic strip is shifted from the center to the edges of the metallic strip, the above roll arrangement will be referred to as "a forming roll arrangement directed outside", hereinafter. As illustrated in FIG. 7, a deviation directed inside with respect to the width direction is caused in the upper roll, and a deviation directed outside with respect to the width direction is caused in the lower roll. In the case of "the forming roll arrangement directed outside", the following problems are caused:

Since the upper roll is not contacted with an extreme edge portion, the edge portion is not sufficiently bent. In the case where the present invention is applied to the W-bend method, the gap becomes narrow due to the deviation, and the wall thickness is locally reduced.

On the other hand, in the case of "the forming roll arrangement directed inside", the above problems are not caused, and further the torsion forces applied to the upper and lower rolls are advantageous for edge forming, and the reduction force of the upper and lower rolls are advantageously reduced. Accordingly, in the case of a roll stand in which torsion tends to occur due to insufficient rigidity, it is preferable to employ "the forming roll arrangement directed inside".

The circumstances explained above are essentially the same as those in which only upper rolls are turned, so that it is preferable to employ "the forming roll arrangement directed inside" in the case where only upper rolls are turned.

With reference to the accompanying drawings, an embodiment of the present invention will be explained as follows.

EXAMPLE 1

FIG. 8(*a*) is a front view of the rolls to which the present invention is applied, and FIG. 8(*b*) is a plan view. In this case, the turning angle $\alpha_d$ of the lower roll 4 is determined in accordance with the forming radius of curvature of the edge portion 13 of the metallic strip 5. In accordance with the width of the metallic strip and the length of a portion of the metallic strip to be bent, the positions of upper and lower rolls on both sides are determined with respect to the width direction. Further, in accordance with the wall thickness of the metallic strip 5, the turning angle $\alpha_u$ of the upper roll 3 is determined.

In the case where the turning angle is determined in accordance with the wall thickness of the metallic strip and the radius of curvature of the portion to be bent, the hysteresis of a roll gap right below the upper roll is shown in FIG. 4. Also, the deformation of the metallic strip according to the roll gap hysteresis is shown in FIG. 3. In these drawings, numeral 3 is an upper roll, numeral 4 is a lower roll, numeral 5 is a metallic strip, and numeral 7 is a center of the metallic strip.

Figure 9:
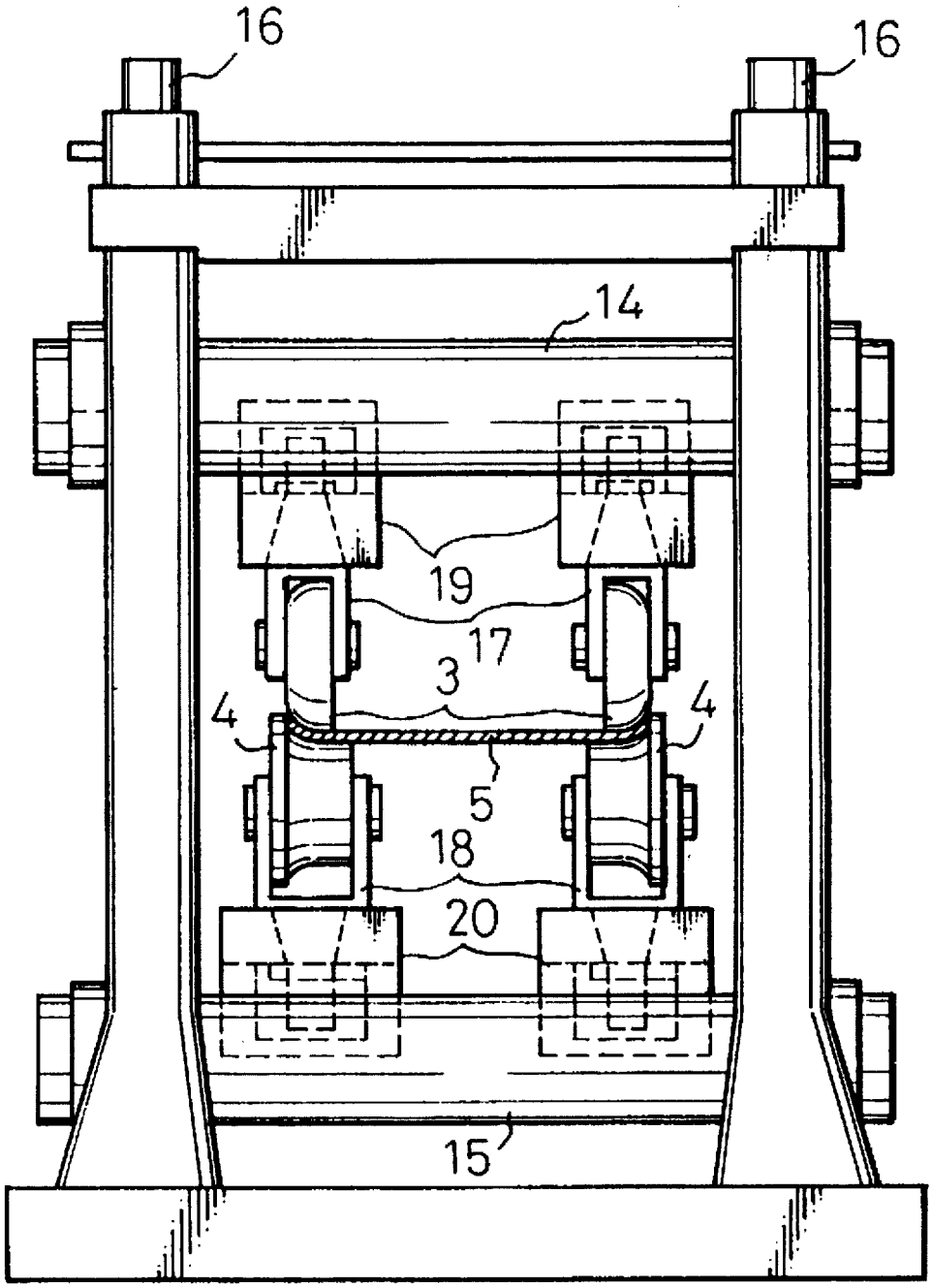
FIG. 9 is a view showing an example of the forming apparatus to which the present invention is applied.

FIG. 9 is a front view of an example of the edge bending roll stand to which the present invention is applied. The roll support beam members 14, 15 vertically hold the upper and lower roll bearing members 17, 18, and the upper roll support beam member 14 is vertically moved and fixed by the action of the reduction screw shaft 16. The upper and lower roll support stands 19, 20 are moved and fixed in the width direction by the rotation of a screw shaft not shown in the drawing or by the sliding motion of a sliding bracket on a rail not shown in the drawing, wherein the screw shaft or the sliding bracket is disposed in the beam members 14, 15. Further, the upper and lower roll support stands 19, 20 are turned and fixed on a vertical shaft by means of a gear drive unit not shown in the drawing.

In this connection, when necessary, bearing members for supporting the middle portions of the upper and lower rolls, or a bearing member for supporting one of them may be fixed to the roll support beam members 14, 15.

In this embodiment, two pairs of upper and lower horizontal rolls are disposed on both sides of the same stands. However, as shown in the seventh embodiment of the present invention, two pairs of upper and lower rolls are disposed at different positions, and after one pair of rolls have completed edge forming of the edge on one side, the other pair of roll start edge forming of the edge on the other side. In this case, the two pairs of forming rolls may be disposed in different roll stands. Further, it is possible to provide a guide roll at the side where edge forming is not conducted.

Figure 10A:
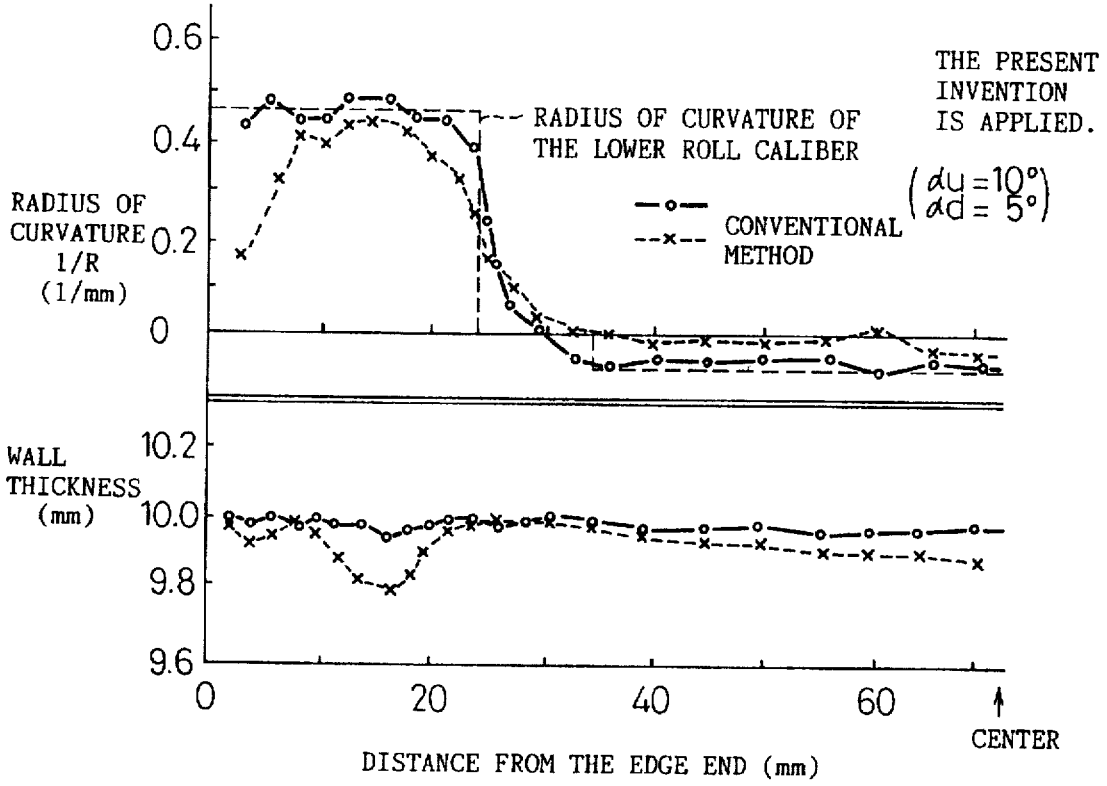
FIGS. 10(*a*) and 10(*b*) are views showing the examples of the distributions in the radius of curvature and wall thicknesses after a metallic strip has passed through a single stand in the case where the present invention is applied and in the case where the present invention is not applied.
Figure 10B:
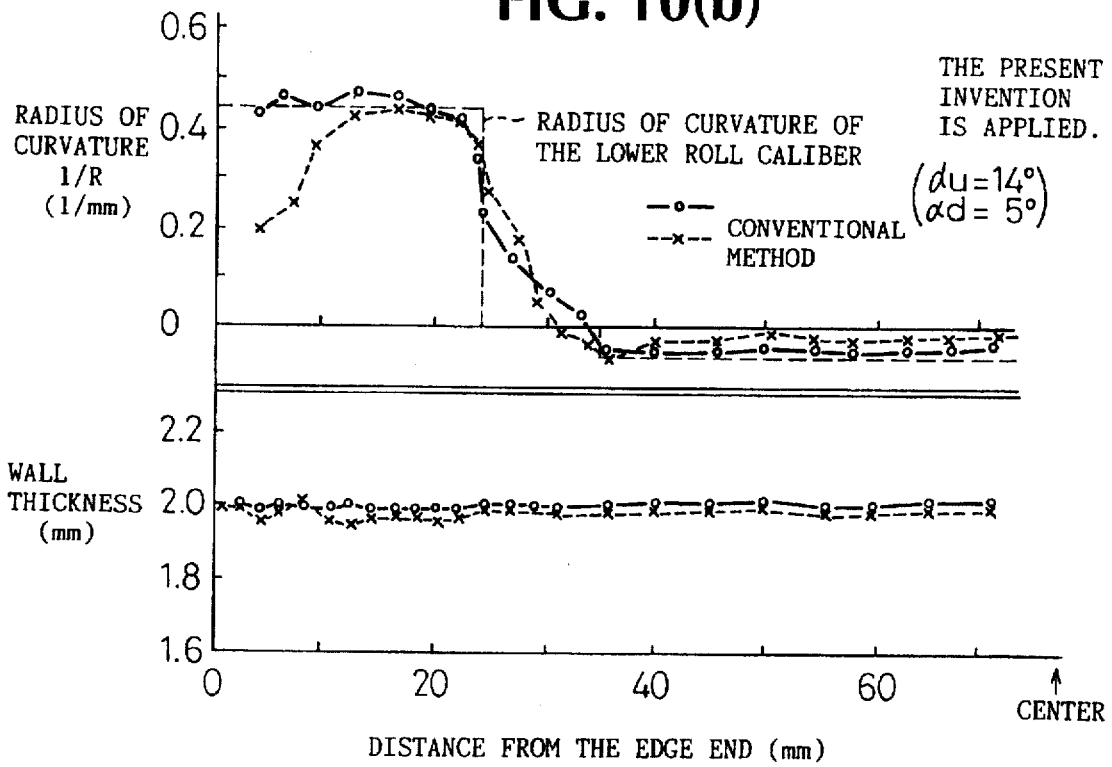

FIGS. 10*a* and 10*b* shows the distributions of radius of curvature and wall thickness after a steel strip of $\phi 50.8\times t2.10$ mm, the yield strength of which was 294N/mm$^2$, was subjected to edge forming, wherein one is a case to which the present invention was applied and the other is a case to which the present invention was not applied. To this example, "the forming roll arrangement directed inside" was applied. According to the conventional method, steel strips of small wall thickness were not sufficiently bent, and indentations were caused on steel strips of large wall thickness. However, in the case where the present invention was applied, excellent profiles were provided.

Figure 11:
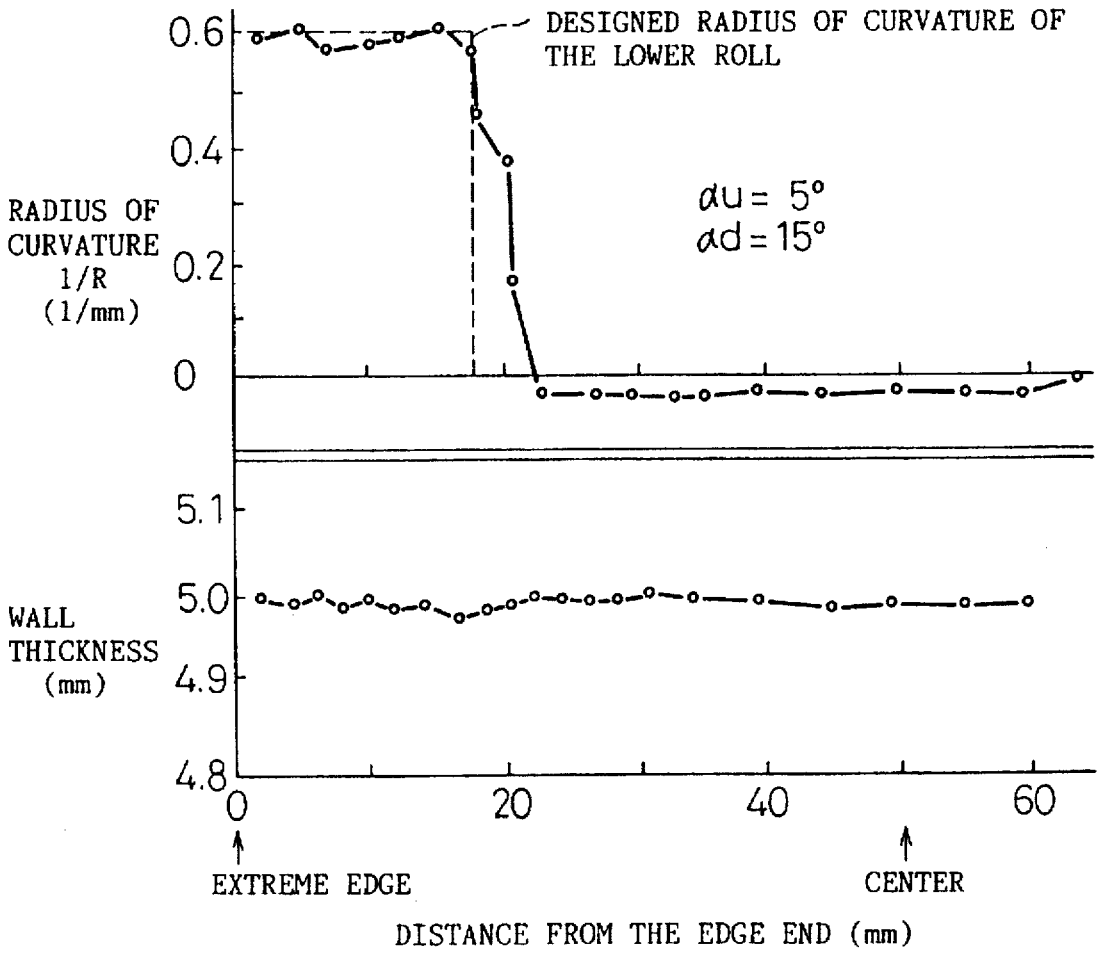
FIG. 11 is a view showing an example of the distributions in the radius of curvature and wall thicknesses expressing the properties of sharing a roll in the case where the present invention is applied.

Further, FIG. 11 shows the distributions of radius of curvature and wall thickness after a steel strip of $\phi 34.0\times t5$ mm was subjected to edge forming, wherein the same forming rolls as those described above were used and the turning angle was adjusted. The obtained radius of curvature was approximately the same as the radius of curvature which was previously set, and further the provided profile was good. It can be seen that the outer diameter of the forming roll can be shared when the present invention is applied.

Table 1 shows the results on the radius of curvature and the reduced wall thickness in the case where edge forming was conducted using the same rolls, wherein the turning angles of the upper and lower rolls were changed with respect to various forming diameter and wall thickness. It can be seen that the edge forming properties were improved, the reduction of wall thickness was decreased, and the roll outer diameter was shared, when the present invention was applied. Further, when the turning angle setting conditions described in the second and third embodiments of the present invention were applied, the effects of the present invention were exhibited to the maximum.

TABLE 1

| No. | Formed size: Outer diameter $\phi$ × wall thickness t (mm) | Forming condition: Upper roll turning angle $\alpha_u$ (°) | Lower roll turning angle $\alpha_d$ (°) | Direction of turning angle | *Radius of curvature | **Ratio of reduced wall thickness | Remark |
|---|---|---|---|---|---|---|---|
| 1 | 50.8 × 0.8 | 0 | 0 | — | 0.6 | 0.025 | Conventional method |
| 2 | 50.8 × 2.0 | 0 | 0 | — | 0.6 | 0.025 | |
| 3 | 50.8 × 5.0 | 0 | 0 | — | 0.75 | 0.044 | |
| 4 | 50.8 × 10.0 | 0 | 0 | — | 0.75 | 0.035 | |
| 5 | 50.8 × 2.0 | 14 | 5 | Forming roll arrangement directed outside | 0.85 | 0.010 | Present Invention |
| 6 | 50.8 × 5.0 | 10 | 5 | Forming roll arrangement directed outside | 0.9 | 0.016 | |
| 7 | 50.8 × 2.0 | 14 | 5 | Forming roll arrangement directed inside | 1.0 | 0.010 | |
| 8 | 50.8 × 5.0 | 10 | 5 | Forming roll arrangement directed inside | 1.0 | 0.008 | |
| 9 | 50.8 × 10.0 | 5 | 5 | Forming roll arrangement directed inside | 1.0 | 0.015 | |
| 10 | 34.0 × 2.0 | 8 | 15 | Forming roll arrangement directed inside | 1.0 | 0.010 | |
| 11 | 34.0 × 5.0 | 5 | 15 | Forming roll arrangement directed inside | 1.0 | 0.008 | |
| 12 | 25.4 × 2.0 | 5 | 35 | Forming roll arrangement directed inside | 0.9 | 0.024 | |
| 13 | 50.8 × 0.8 | 50 | 5 | Forming roll arrangement directed inside | 0.8 | 0.022 | |

*) Average value of the ratio of a targeted radius of curvature to an obtained radius of curvature in edge forming, wherein the average value is taken in an edge forming region $R_0/R$ ($R_0$: targeted radius of curvature in edge forming, R: obtained radius of curvature in edge forming)

**) Reduction of wall thickness/initial wall thickness

EXAMPLE 2

Figure 12B:
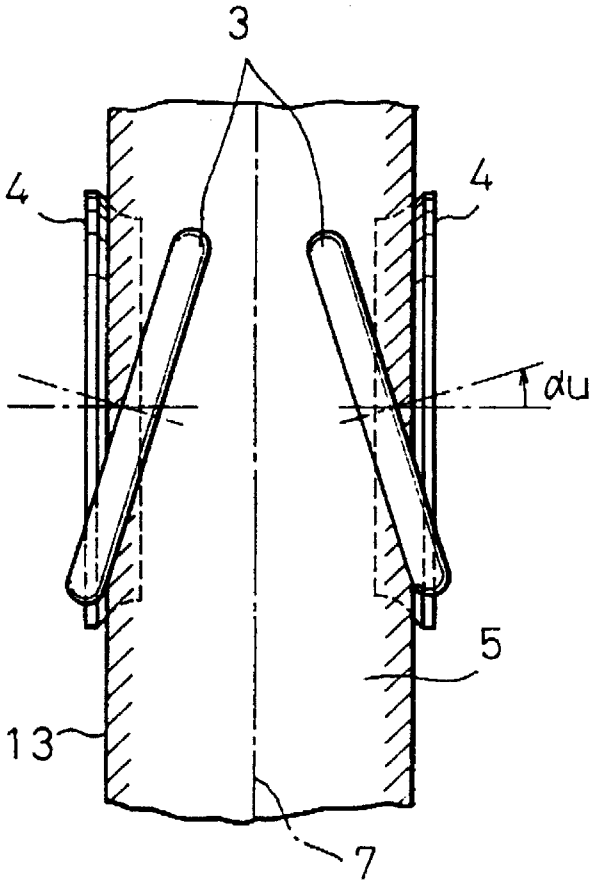
FIGS. 12(*a*) and 12(*b*) are views showing an example of the roll to which the present invention is applied, wherein FIG. 12(*a*) is a front view and FIG. 12(*b*) is a plan view.
Figure 12A:
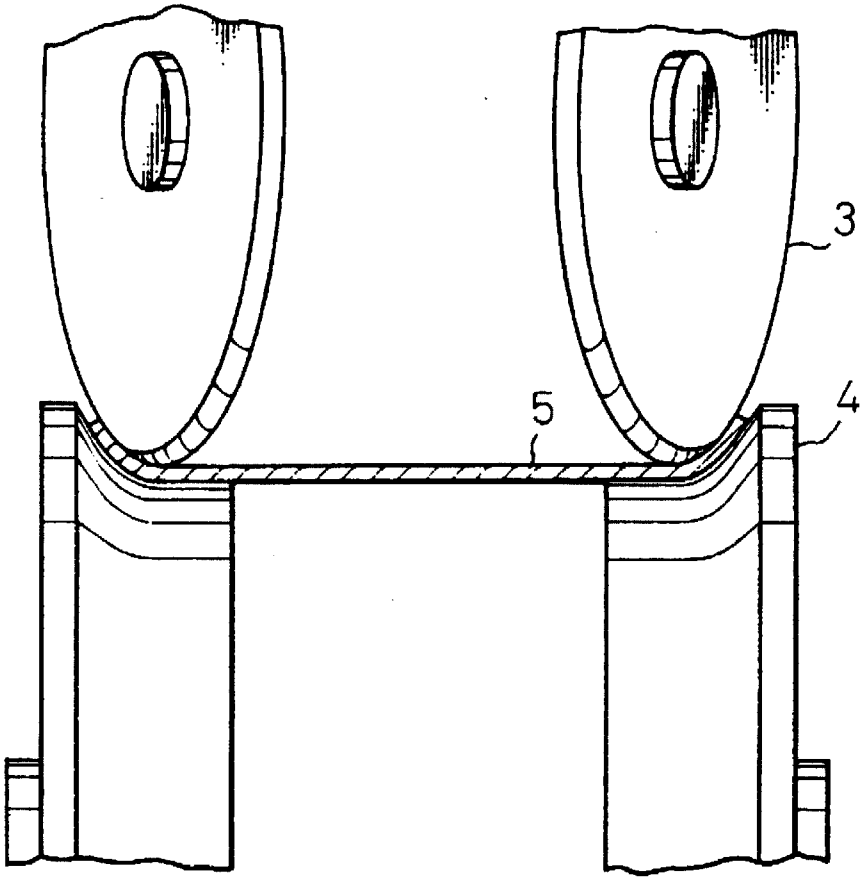

FIG. 12(*a*) is a front view, and FIG. 12(*b*) is a plan view, of the rolls to which the present invention is applied. The dimensions of the lower roll 4 are determined in accordance with the width of the metallic strip 5 and the length of a portion of the metallic strip 5 to be bent, and the positions of upper and lower roll on both sides with respect to the width direction are also determined in accordance with the width of the metallic strip 5 and the length of a portion of the metallic strip 5 to be bent. Further, in accordance with the wall thickness of the metallic strip 5, the turning angle $\alpha_u$ of the upper roll 3 is determined, and numeral 7 is a central portion of the metallic strip.

In the case where the turning angle of the forming roll is determined in accordance with the wall thickness and the radius of curvature of edge forming, the hysteresis of the upper roll gap right below the upper roll 3 is shown in FIG. 4, and the hysteresis of the lower roll is the same as that of the conventional case. Circumstances of the metallic strip deformed in accordance with the roll gap hysteresis are shown in FIG. 3, in which numeral 3 is an upper roll, numeral 4 is a lower roll, and numeral 5 is a metallic strip.

Figure 13:
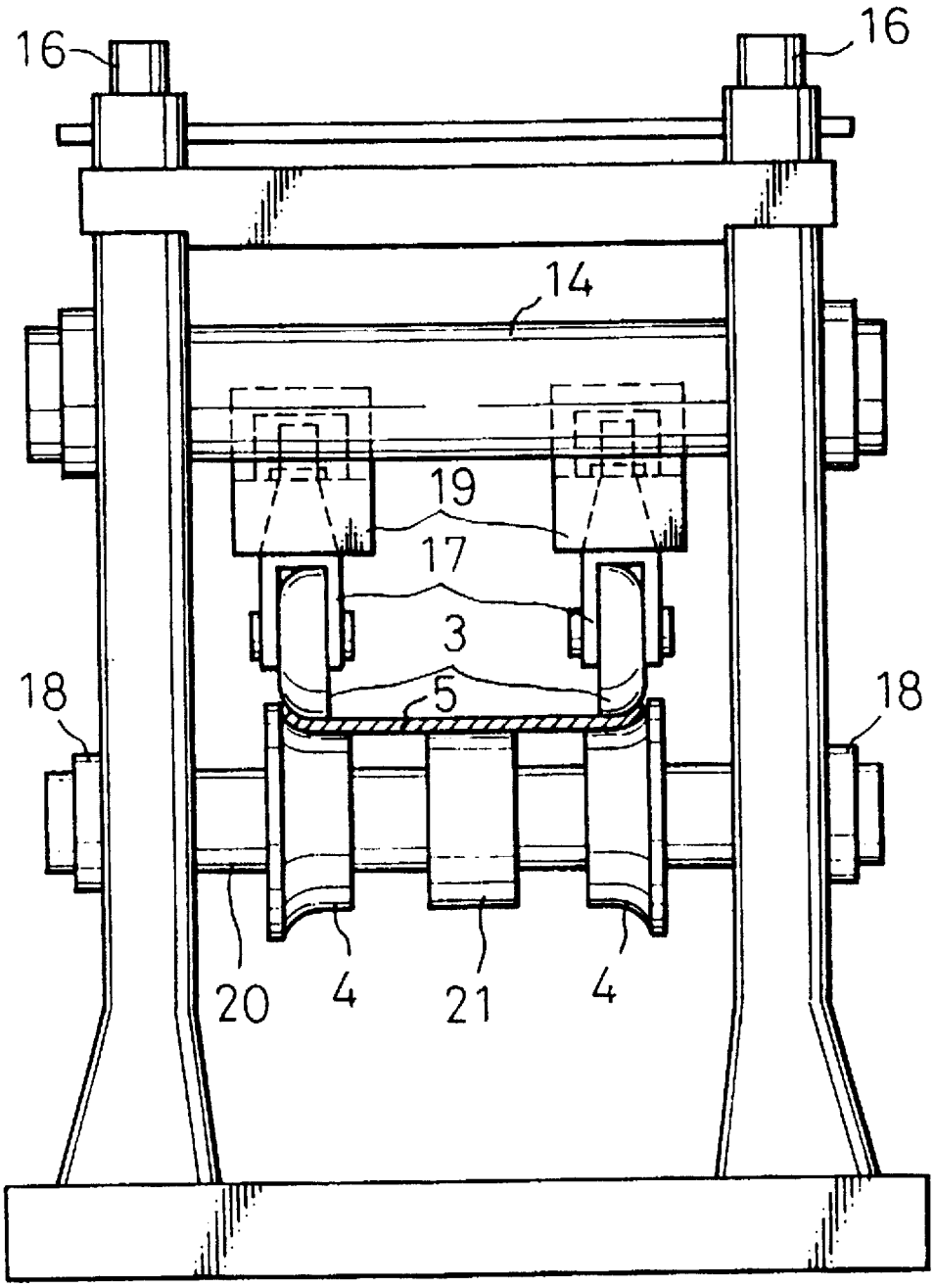
FIG. 13 is a view showing an example of the forming apparatus to which the present invention is applied.

FIG. 13 is a front view of the exemplary edge bend roll stand to which the present invention is applied. The roll support beam member 14 vertically holds the upper roll bearing member 17, and the upper roll support beam member 14 is vertically moved and fixed by the action of the reduction screw shaft 16. The upper roll support stand 19 is moved and fixed in the width direction by the rotation of a screw shaft not shown in the drawing or by the sliding motion of a sliding bracket on a rail not shown in the drawing, wherein the screw shaft or the sliding bracket is disposed in the beam member 14. Further, the upper roll support stand 19 is turned and fixed on a vertical shaft by means of a gear drive unit not shown in the drawing. On the other hand, the lower rolls 4 can be rotated by the lower roll shaft 20 through the lower roll bearing members 18. Further, the positions of the lower rolls 4 can be changed and fixed in the width direction by means of a screw means or hydraulic means not shown in the drawing.

In this connection, when necessary, a bearing member for supporting the middle portion of the upper roll may be fixed to the roll support beam member 14.

According to the results showing the distributions of radius of curvature and wall thickness after a steel strip of $\phi$50.8×t2.10 mm, the yield strength of which was 294N/

$mm^2$, was subjected to edge forming though a single stand, wherein one was a case to which the present invention was applied and the other was a case to which the present invention was not applied, in the case where the conventional method was applied, steel strips of small wall thickness were not sufficiently bent, and indentations were caused on steel strips of large wall thickness. However, in the case where the present invention was applied, excellent profiles were provided.

Table 2 shows the results of radius of curvature and reduced wall thickness in the case where edge forming was conducted using the same rolls, wherein the turning angles of the upper roll was changed with respect to various wall thickness. It can be seen that the edge forming properties were improved and the reduction of wall thickness was decreased when the present invention was applied. Further, when the turning angle setting conditions described in the fifth and sixth embodiments of the present invention were applied, the effects of the present invention were exhibited at the maximum.

TABLE 2

| No. | Formed size: Outer diameter $\phi$ × wall thickness t (mm) | Forming condition: Upper roll turning angle $\alpha_u$ (°) | Lower roll turning angle $\alpha_d$ (°) | Direction of turning angle | *Radius of curvature | **Ratio of reduced wall thickness | Remark |
|---|---|---|---|---|---|---|---|
| 1 | 50.8 × 0.8 | 0 | 0 | — | 0.6 | 0.025 | Conventional method |
| 2 | 50.8 × 2.0 | 0 | 0 | — | 0.6 | 0.025 | |
| 3 | 50.8 × 5.0 | 0 | 0 | — | 0.75 | 0.044 | |
| 4 | 50.8 × 10.0 | 0 | 0 | — | 0.75 | 0.035 | |
| 5 | 50.8 × 2.0 | 14 | 5 | Forming roll arrangement directed outside | 0.85 | 0.010 | Present Invention |
| 6 | 50.8 × 5.0 | 10 | 5 | Forming roll arrangement directed outside | 0.9 | 0.016 | |
| 7 | 50.8 × 2.0 | 14 | 5 | Forming roll arrangement directed inside | 1.0 | 0.010 | |
| 8 | 50.8 × 5.0 | 10 | 5 | Forming roll arrangement directed inside | 1.0 | 0.008 | |
| 9 | 50.8 × 10.0 | 5 | 5 | Forming roll arrangement directed inside | 1.0 | 0.015 | |
| 10 | 50.8 × 0.8 | 50 | 15 | Forming roll arrangement directed inside | 0.8 | 0.022 | |

*) Average value of the ratio of a targeted radius of curvature to an obtained radius of curvature in edge forming, wherein the average value is taken in an edge forming region $R_0/R$ ($R_0$: targeted radius of curvature in edge forming, R: obtained radius of curvature in edge forming)

**) Reduction of wall thickness/initial wall thickness

[Industrial Availability]

As described above, according to the present invention, when a metallic strip is continuously formed by rolls and then welded so as to manufacture a welded pipe, the metallic strip is subjected to edge forming by the breakdown roll unit provided in the initial edge forming process without the deterioration of accuracy of the wall thickness of the metallic strip to be formed. Further, the forming roll can be shared when metallic strips for various pipe diameters are formed.

We claim:

1. A method for bending edges of a metallic strip in a roll stand having a strip entry side and a delivery side, said strip having a predetermined width and a longitudinal centerline, said method comprising:

providing in said roll stand an upper pair of rolls with each roll having a center, a horizontal axis passing through its center, and a vertical axis passing through its center, the horizontal axis of each roll of said upper pair being in a common first horizontal plane;

providing in said roll stand a lower pair of rolls with each roll having a center, a horizontal axis passing through its center, and a vertical axis passing through its center, the horizontal axis of each roll of said lower pair being in a common second horizontal plane spaced below said first horizontal plane;

spacing a first roll of said upper pair from a second roll of said upper pair at a distance in the horizontal direction determined by said width of said metallic strip;

spacing a first roll of said lower pair from a second roll of said lower pair at a distance in the horizontal direction determined by said width of said metallic strip;

turning each roll of the upper pair of rolls about its vertical axis in a first direction to a selected upper turning angle $\alpha u \leqq 45°$, wherein $\alpha u$ is an angle between the horizontal axis of each upper roll and the horizontal line perpendicular to the longitudinal centerline of said metallic strip;

turning each roll of the lower pair of rolls about its vertical axis in a second direction opposite to the first direction to a selected lower turning angle $\alpha d \leqq 30°$, wherein $\alpha d$ is an angle between the horizontal axis of each lower roll and a horizontal line perpendicular to the longitudinal centerline of said metallic strip;

bending the edges of said metallic strip by passing said metallic strip between said upper pair and said lower pair of rolls.

2. A method according to claim 1 further comprising:

turning each roll of the upper pair of rolls about its vertical axis in a first direction resulting in each roll of the upper pair of rolls being directed toward a respective edge of the metallic strip at the entry side of the roll stand and being directed toward the longitudinal centerline of said metallic strip at the delivery side of said roll stand.

3. A method for bending edges of a metallic strip in a roll stand having a strip entry side and a delivery side, said strip having a predetermined width and a longitudinal centerline, said method comprising:

providing in said roll stand an upper pair of rolls with each roll having a center, a horizontal axis passing through its center, and a vertical axis passing through its center, the horizontal axis of each roll of said upper pair being in a common first horizontal plane, and each roll of said upper pair of rolls having a convex circumferential periphery;

providing in said roll stand a lower pair of rolls with each roll having a center, a horizontal axis passing through its center, and a vertical axis passing through its center, the horizontal axis of each roll of said lower pair being in a common second horizontal plane spaced below said first horizontal plane, and each roll of said lower pair of rolls having a concave circumferential periphery;

spacing a first roll of said upper pair from a second roll of said upper pair at a distance in the horizontal direction determined by said width of said metallic strip;

spacing a first roll of said lower pair from a second roll of said lower pair at a distance in the horizontal direction determined by said width of said metallic strip;

turning each roll of the upper pair of rolls having said convex circumferential periphery about its vertical axis in a first direction to a selected upper turning angle $\alpha u \leqq 45°$, wherein $\alpha u$ is an angle between the horizontal axis of each upper roll and a horizontal line perpendicular to the longitudinal centerline of said metallic strip so that the upper turning angle coordinates with an inner curvature to be formed by bending edges of said metallic strip;

said turning each roll of the upper pair of rolls having said convex circumferential periphery about its vertical axis in said first direction resulting in each roll of the upper pair of rolls being directed to a respective edge of said metallic strip at the entry side of the roll stand and being directed towards the longitudinal center line of said metallic strip at the delivery side of said roll stand;

maintaining each roll of the lower pair of rolls having said concave circumferential periphery in a position wherein the horizontal axis of each lower roll is perpendicular to the longitudinal centerline of said metallic strip;

bending the edges of said metallic strip by passing said metallic strip between said upper pair of rolls, each having said convex circumferential periphery, and said lower pair of rolls, each having said concave circumferential periphery.

4. A roll stand for bending edges of a metallic strip having a width comprising:

an upper pair of rolls disposed in said roll stand wherein each roll has a center, a horizontal axis passing through its center, and a vertical axis passing through its center, with the horizontal axis of each roll of said upper pair located in a common first horizontal plane;

a lower pair of rolls disposed in said roll stand wherein each roll has a center, a horizontal axis passing through its center, and a vertical axis passing though its center, with the horizontal axis of each roll of said lower pair located in a common second horizontal plane spaced below said first horizontal plane;

means for spacing a first roll of said upper pair from a second roll of said upper pair at a distance in the horizontal direction determined by the width of the metallic strip to be bent;

means for turning each roll of said upper pair about its vertical axis;

means for spacing a first roll of said lower pair from a second roll of said lower pair at a distance in the horizontal direction determined by the width of the metallic strip to be bent;

means for turning each roll of said lower pair about its vertical axis;

the pair of upper and lower rolls disposed in the roll stand wherein the upper pair of rolls are located at a different position from the lower pair of rolls in each common horizontal plane.

* * * * *